US006573036B2

(12) United States Patent
Van den Zegel et al.

(10) Patent No.: US 6,573,036 B2
(45) Date of Patent: Jun. 3, 2003

(54) SINGLE-SIDE COATED SILVER HALIDE PHOTOGRAPHIC FILM MATERIAL HAVING REDUCED TENDENCY TO CURL

(75) Inventors: Mark Van den Zegel, Boortmeerbeek (BE); Francis Vanhoudt, Edegem (BE); Frank Ruttens, Overijse (BE); Guy Damen, Kasterlee (BE)

(73) Assignee: Afga-Gevaert, Mortsel (BE)

( * ) Notice: Subject to any disclaimer, the term of this patent is extended or adjusted under 35 U.S.C. 154(b) by 0 days.

(21) Appl. No.: 09/829,728

(22) Filed: Apr. 10, 2001

(65) Prior Publication Data

US 2002/0018954 A1 Feb. 14, 2002

Related U.S. Application Data

(60) Provisional application No. 60/201,669, filed on May 3, 2000.

(30) Foreign Application Priority Data

Apr. 10, 2000 (EP) ..... 00201286

(51) Int. Cl.[7] ..... G03C 1/76; G03C 1/81

(52) U.S. Cl. ..... 430/523; 430/502; 430/510; 430/527; 430/531; 430/609; 430/621; 430/628; 430/631; 430/639; 430/640; 430/641; 430/966; 430/967; 430/930

(58) Field of Search ..... 430/502, 510, 430/523, 527, 531, 609, 621, 628, 631, 639, 966, 967, 930

(56) References Cited

U.S. PATENT DOCUMENTS

| | | | | | |
|---|---|---|---|---|---|
| 3,615,555 | A | | 10/1971 | Grabhoefer et al. | |
| 4,427,764 | A | * | 1/1984 | Tachibana et al. | 430/523 |
| 4,859,576 | A | * | 8/1989 | Miyasaka et al. | 430/523 |
| 4,945,036 | A | * | 7/1990 | Arai et al. | 430/567 |
| 5,001,044 | A | * | 3/1991 | Toya | 430/523 |
| 5,107,125 | A | * | 4/1992 | Powell et al. | 250/483.1 |
| 5,229,246 | A | * | 7/1993 | Shibata et al. | 430/217 |
| 5,466,541 | A | * | 11/1995 | Van Havenbergh et al. | 428/690 |
| 5,468,599 | A | * | 11/1995 | Biavasco et al. | 430/512 |
| 5,482,813 | A | | 1/1996 | Tadashi | 430/139 |
| 5,576,155 | A | * | 11/1996 | Muessig-Pabst et al. | 430/502 |
| 5,693,370 | A | * | 12/1997 | Van den Zegel | 427/414 |
| 5,733,715 | A | * | 3/1998 | Verbeeck et al. | 430/567 |
| 5,965,318 | A | * | 10/1999 | Goedeweeck et al. | 430/139 |
| 6,027,866 | A | * | 2/2000 | Ohzeki | 430/521 |
| 6,200,743 | B1 | * | 3/2001 | Elst et al. | 430/576 |
| 6,238,853 | B1 | * | 5/2001 | Baecke et al. | 430/445 |

FOREIGN PATENT DOCUMENTS

| | | | |
|---|---|---|---|
| EP | 0 933 670 | 8/1999 | 60305/17 |

* cited by examiner

*Primary Examiner*—Tom Dunn
*Assistant Examiner*—Amanda C. Walke
(74) *Attorney, Agent, or Firm*—Joseph T. Guy; Nexsen Pruet Jacobs & Pollard, LLC

(57) ABSTRACT

A single-side coated light-sensitive silver halide photographic film material has been disclosed, having on one side of a subbed support, one or more light-sensitive silver halide emulsion layer(s) overcoated with an outermost protective layer; and, at the other side of said support, a backing layer, covered with a protective outermost layer, characterized in that at least said backing layer is provided with a layer wherein, besides a cross-linked or cross-linkable first binder an organic component free from cross-linking upon reaction with a hardener is present as a second binder having a low molecular weight.

18 Claims, No Drawings

SINGLE-SIDE COATED SILVER HALIDE PHOTOGRAPHIC FILM MATERIAL HAVING REDUCED TENDENCY TO CURL

This application claims the benefit of Provisional application Ser. No. 60/201,669 filed May 3, 2000.

FIELD OF THE INVENTION

The present invention relates to single-side coated black-and-white imaging elements comprising a support material, an image-forming layer on one side, and a backing layer on the other side.

BACKGROUND OF THE INVENTION

In medicine examination of classically processed silver halide radiographic diagnostic film materials is normally performed on a light box. In one embodiment said films storing the diagnostic image are obtained by irradiation, with X-rays emitted from an X-ray generating device, of part of the human body to be examined, followed by modulation of said X-rays and detection with a radiographic X-ray conversion screen, also called intensifying screen, fluorescent screen or phosphor screen. The luminescent phosphor particles present in dispersed form in a layer of the said X-ray conversion screen absorb X-rays and convert them into visible light, thus exposing the radiographic silver halide film material brought into intimate contact with said X-ray conversion screen with the emitted visible light. After film processing, comprising the steps of developing, fixing, rinsing and drying, the diagnostic image is obtained which can be read on a light box.

The film material may be coated with hydrophilic light-sensitive silver halide emulsion layers on one or on both sides of the film support, depending on the application. In chest radiography e.g. wherein priority is given to a high sensitivity after rapid processing (high throughput) the film support is coated with the said light-sensitive layers at both sides. During X-ray exposure both sides of the double-side coated or duplitized film material are in direct contact with an intensifying screen. As a consequence of cross-over light exposure of such a screen-film system, wherein the film is sandwiched between both screens it can be expected to loose image definition. Examples of systems comprising double-side coated film materials in contact with two screens and measures in order to minimize cross-over exposure can be found in quite a lot of references as e.g. in EP-A's 0 486 783, 0 552 116, 0 591 747, 0 862 083 and 0 890 873, without however being limited thereto.

As otherwise there is no other field of medical radiology demanding such a high level of image quality as mammography and as the ability of the mammogram to portray relevant diagnostic information is highly determined by the image definition of the screen-film system, it is recommended to use one single screen, in contact with a single-side coated film material. In the said film material the single thin, light-sensitive emulsion layer thus preferably comprises fine silver halide emulsion grains or crystals dispersed in a binder. Examples of screen-film systems comprising one film in contact at the emulsion side with only one screen and measures in order to get high image definition without losing too much sensitivity (speed) has been disclosed e.g. in EP-A's 0 482 603, 0 610 609, 0 712 036, 0 874 275 and 0 933 670.

In another embodiment hardcopies of images, produced by electronic diagnostic techniques such as computer tomography, magnetic resonance imaging, ultrasound etc., by means of a digital laser should provide examination facilities on light boxes as well. A laser imager is a digital system containing a high performance digital computer: instead of just printing the images, the incoming images can be stored temporarily in an electronic memory and the data as well as the lay-out of the images can be manipulated before actually being printed on a film. This electronic memory offers the possibility to buffer the incoming data from several diagnostic modalities by means of an image network, which is a real advantage in comparison with e.g. CRT imaging wherein the hard copy is exposed image by image. In that case, while one examination is taking place, the imager is unavailable for others and as a result, each diagnostic unit requires a separate CRT imager. The photographic hardcopy material, used in the laser imagers, must combine an excellent image quality with the appropriate physical properties, necessary for an error free filmhandling by the imager. With regard to image quality, the photographic material preferably has high sharpness, a good image tone (color hue) of the developed silver, preferably a purely black image, a preferred gloss level, and appropriate contrast values to allow a high maximum density and crisp alfanumerics. Rapid access of the photographic images is also highly desired in this application. Especially when implemented in an image network, the access time of the laser hardcopy material should be as short as possible. Factors responsible for delayed rates at which the process proceeds may be the exposure time of the film by the laser, the transport time before exposure to the system and after exposure to an automatic processor, and the processing time, dry-to-dry, of the hardcopy material. Whereas the exposure time and transport time are dependent on specific features of the laser source, the mechanical construction of the system and the dimensions of the hardcopy material, the processing time is especially determined by the film characteristics (sensitivity, also called "speed") and the chemicals used in the processing cycle. Typical modern processors have dry-to-dry cycles of less than 60 seconds, more preferable less than or equal to 50 seconds. Such materials, film/screen combinations and/or processing methods thereof have e.g. been described in EP-A's 0 610 608, 0 679 015 and 0 794 456.

Whereas thanks to a symmetrical layer arrangement of double-side coated radiographic materials there is no problem during examination on a light box of the processed film material, a real problem of curling can be expected when there is an asymmetrical layer arrangement with, apart from outermost protective layers, a light-sensitive emulsion layer on one side of the support and a backing layer at the other side. This problem becomes not only stringent after, but already before processing, and an equilibrium between the load of coated components in the respective layers is therefore highly recommended. Measures in order to avoid curling, particularly related with a mechanical impact can be found in EP-A's 0 520 420 and 0 568 268.

The problem particularly appears when a dried, processed material is hanging during some time on a light box for examination purposes. As most of the time diagnosis on a mammographic film material is performed by viewing on a light-box through the back side of the film, any curl towards the backing layer is annoying the radiologist. Appearance of curl is a consequence of a decrease of load of coated material layers when the said material becomes processed as the amount of silver changes rather drastically in the processing. In addition warming up in the direct environment of the glass surface outside the light box creates a local atmosphere having low relative humidity (lower than 30% R.H.) a single side coated film material tends to curl in the direction towards the backing layer.

Load of the layers on both sides of the film support with components in order to get a perfect equilibrium and to prevent curl after drying of the coated wet layers may form a first problem during the coating process as the material is also loaded with high amounts of water which should be evaporated. During storage and handling, and before processing problems however look easy to overcome and are predominantly determined by atmospheric conditions of the environment, particularly by heat (temperature) and humidity. The film material is thus optimized in order to reduce curl to a low level.

The problem is posed however to a much larger extent by the processing steps, during which the coated hydrophilic layers are penetrated by high amounts of aqueous solutions of developing compounds from the developer, followed by aqueous fixing solutions of fixing compounds, optionally rinsed out in an intermediate rinsing steps but always rinsed out during the rinsing step with washing water after fixation. More particularly during said rinsing or washing steps not only reacted and unreacted developing or fixing compounds from the processing solutions are leaving the swollen layers again but also originally coated hydrophilic components may leave the said layers. After drying said layers (in a determined drying time, in conditions characteristic for the automatic processing machine wherein the processing has been performed) the components left in the respective hydrophilic layers at both sides of the support will be decisive for the result obtained with respect to curl of the material, hanging on the light box.

So curl towards the (light-sensitive) emulsion side appearing after coating and drying may be compensated by addition of softening polymers for the binder (like e.g. acrylic or methacrylic acid latex polymers are for gelatin as a binder) determining the hardening degree of the binder and the amount of processing liquid (inclusive for rinsing water) absorbed in the processing time and temperature as set forth in the processing cycle. A disadvantage often encountered however is the occurrence of curling towards the backing layer after processing, as the hydrophobe-hydrophile balance providing equilibrium between both sides has been changed. Moreover not all of the components added are without influence upon sensitometry.

It is clear that the problem becomes even more severe when higher amounts of silver halide have been coated, requiring higher amounts of components loading the coated layers before and after processing, like gelatin binder and other polymers.

OBJECTS OF THE INVENTION

It is an object of the present invention to provide a single-side coated material having low tendency to curl before as well as after processing.

Moreover it is an object not to load the light-sensitive layer(s) containing silver halide emulsion crystals with latex polymers in an amount of more than 30%, and even more preferably, not more than 20%.

It is a further object of the invention to prevent curl when said material is hanging on a light box for examination purposes.

Other objects will become apparent from the description and from the examples hereinafter.

SUMMARY OF THE INVENTION

The above mentioned objects are realized by providing Single-side coated light-sensitive silver halide photographic film material comprising, on one side of a subbed support, one or more light-sensitive silver halide emulsion layer(s) overcoated with an outermost protective layer; said emulsion layer(s) having silver halide grains dispersed in binder, wherein said silver halide is coated in a total amount, expressed as an equivalent amount of silver nitrate of more than 5 g per $m^2$, a latex polymer present in an amount of less than 30% by weight versus said binder, and, at the other side of said support, a backing layer, covered with a protective outermost layer, characterized in that at least said backing layer is provided in at least one layer thereof, besides a cross-linked or cross-linkable first binder, with an organic component free from cross-linking upon reaction with a hardener, as a second binder, wherein said organic component is a polymer selected from the group consisting of dextran having a molecular weight of not more than 20000 and polyacrylamide having a molecular weight not more than 20000.

Specific features for preferred embodiments of the invention are disclosed in the dependent claims.

Further advantages and embodiments of the present invention will become apparent from the following description and from the examples hereinafter.

DETAILED DESCRIPTION OF THE INVENTION

While the present invention will hereinafter be described in connection with preferred embodiments thereof, it will be understood that it is not intended to limit the invention to those embodiments. A single-side coated light-sensitive silver halide photographic film material is disclosed herein, wherein, according to the present invention one or more light-sensitive silver halide emulsion layer(s) is (are) present, said emulsion layer(s) having silver halide grains dispersed in binder and coated in a total amount, expressed as an equivalent amount of silver nitrate, of more than 5 g per $m^2$, i.a. at least 5.2 g/$m^2$. In a preferred embodiment according to the present invention said silver halide is coated in a total amount, expressed as an equivalent amount of silver nitrate, of more than 7.5 g per $m^2$ and still more preferably up to at most 10.0 g/$m^2$.

Besides said binder a latex polymer is present in said emulsion layer(s) in an amount of less than 30% by weight versus said binder, and more preferably less than 20%, coated on only one side of a subbed support and protected by an outermost protective overcoat layer adjacent thereto. At the other side of said subbed support, a backing layer is present, covered with a protective outermost layer, further characterized in that at least said backing layer is provided, in at least one layer thereof, with an organic component free from cross-linking upon reaction with a hardener. According to the present invention said organic component free from cross-linking upon reaction with a hardener is a polymer selected from the group consisting of dextran having a(n) (average or mean) molecular weight of from 1000 up to not more than 20000 and polyacrylamide having a(n) (average) molecular weight of from 1000 up to not more than 20000. Organic substances which may also be present are those selected from the group essentially consisting of pullulan and saccharose. It may be advisable to make use of polymers having a well-known molar distribution in that a higher fraction of polymer component having a low molecular weight (less than 20000) is present and a lower fraction of polymer component having a high molecular weight (more than 20000), wherein said (heterogeneous) molar distribution is determined by the preparation method and, more particularly, the stearing parameters used therein during the synthesis.

In one embodiment according to the present invention in at least one layer of said backing layer of the inventive material, the organic component free from cross-linking upon reaction with a hardener should be present in an amount of at least 50% by weight versus the amount of cross-linked or cross-linkable first binder.

In a preferred embodiment according to the present invention said at least one layer of said backing layer in the inventive material is the first layer of said backing layer, being the layer more close to the subbed support than any other layer.

In the material of the present invention a preferred cross-linked or cross-linkable first binder is gelatin, well-known as hydrophilic protective colloid binder.

Polymers other than gelatin like polyacrylamide, polyvinyl alcohol, polyvinyl pyrrolidone, dextran having a molecular weight of at least 20000, and, preferably more than 50000 may advantageously be used, particularly in the light-sensitive emulsion layer, in favour of covering power after processing.

Other examples of binders which can further be used in the various layers of the silver halide recording material are synthetic polymers such as polymers or copolymers made of vinyl alcohol, N-vinyl pyrrolidone, acrylamide, acrylic acid, methacrylic acid, vinyl imidazole, vinyl pyrazole, as well as natural polymers such as casein, gelatin (acidically or alkalinically processed, made of bovine bones or pigskins), cellulose and cellulose derivatives, alginates, albumin, starch and colloidal silica stabilized by organic onium compounds, as well as modified polymers such as hydroxyethyl cellulose, hydrolyzed gelatin, chemically modified gelatin as described, for example, in U.S. Pat. No. 5,087,694, chemically modified and hydrolyzed gelatin as described, for example, in DE 2,166,605 and in U.S. Pat. No. 3,837,861. Mixtures of binders can also be used in the individual layers, wherein the preferred main component of a binder mixture or wherein the only binder in the layers of photographic recording materials is gelatin. Preferred alkaline processed bovine bone gelatin as a protective colloid used for the silver halide crystals and binder in the emulsion layer can be ion-exchanged. Preferably, a weight ratio of silver (expressed as equivalent amount of silver nitrate) to binder or binder mixture in the light-sensitive emulsion layer at one side of the subbed support is less than 0.7, and more preferably less than 0.5, resulting in sufficient drying after processing and a low pressure sensitivity in the wet state. This ratio (of amounts, both expressed by weight) may be established, for example, during the production of the silver halide emulsion by means of the amount of binder to be added relative to the amount of silver and a correction thereof can be made before coating by addition of more binder material.

According to the present invention the material has (one or more) organic component(s) free from cross-linking upon reaction with a hardener present in an amount of from 0.5 up to 5 g/m$^2$. Whereas part of the binder material in the first or another backing layer is thus free from cross-linking upon reaction with a hardener, the other part is conventionally hardenable with various cross-linking agents. Optionally the same applies for the light-sensitive emulsion layer(s) at the other side of the support. In a preferred embodiment said binder material free from cross-linking upon reaction with a hardener is present in at least the (non-light-sensitive) backing layer(s) in an amount of more than 1 g per sq.m., more preferably more than 2 g per sq.m. and even up to 4 g per sq.m.. Otherwise said binder material free from cross-linking upon reaction with a hardener is, optionally, present in the light-sensitive layer at the other side of the support in an amount of more than 1 g per sq.m., up to at most 4 g per sq.m..

Cross-linking agents suitable for use have e.g. been described in Research Disclosure, No. 36544, September 1994, Chapter II, p. 508. Hardeners preferably used for the preferred gelatinous binder include glutardialdehyde, 2,4-dichloro-6-hydroxy-1,3,5-triazine, compounds containing an active vinyl group like vinyl sulfonyl hardeners as described e.g. in JP-B 95113745 or the novel sulfonamido or sulfonato substituted vinyl sulfonyl hardeners disclosed in JP-A 10-325987, as well as the well-known 1,3-vinylsulfonyl-2-propanol or di-(vinylsulfonyl)-methane, vinyl sulfonyl-ether compounds and vinyl sulfonyl compounds having soluble groups and other active vinyl compounds as e.g. 1,3,5-triacryloyl-hexahydro-s-triazine,; halo-substituted formamidinium salts, and carbamoyl ammonium or pyridinium salts salts as disclosed in U.S. Pat. No. 4,063,952 and with the onium compounds as disclosed in EP-A 0 408 143, carbonyl pyridinium type compounds as disclosed in JP-A 08-015802, pyrrolidono-carbonylpyridinium salt hardeners as described in JP-A 08-211535, polymeric hardeners, phosphoric esters with nitrogen-oxygen bonds as in EP-A 0 638 842 as well as those disclosed in U.S. Pat. No. 5,766,820 and organic hardening compounds of the epoxide type and of the ethylenimine type, aldehydes as e.g. formaldehyde, glyoxal and glutaraldehyde, N-methylol compounds as e.g. dimethylolurea and methyloldimethyl hydantoin, dioxan derivatives e.g. 2,3-dihydroxy-dioxan, active halogen compounds e.g. 2,4-dichloro-6-hydroxy-s-triazine, and mucohalogenic acids e.g. mucochloric acid and mucophenoxychloric acid. Besides organic hardening agents inorganic compounds may be used such as chromium salts like chromium alum and chromium acetate. These hardeners can be used alone or in combination.

According to the present invention said hardener or hardening compound is a vinyl sulfonyl hardener. Suitable examples thereof can be found in EP-A's 0 29 127, 0 98 454, 0 115 351, 0 207 399, 0 497 143, and 0 752 615, as well as in U.S. Pat. Nos. 3,490,911; 3,582,339; 3,628,961; 3,832,181; 4,007,163; 4,057,538; 4,396,709; 4,670,377; 4,680,257; 4,897,344 and 5,071,736. A suitable preparation method in order to obtain such vinyl sulfonyl hardener has e.g. been described in EP-A 0 770 908.

The same applies to the conventionally hardenable binder material present in the light-sensitive silver halide emulsion layer or layers at the other side of the support, wherein besides said binder material a latex polymer is present in an amount of less than 30% by weight and, more preferably, even less than 20% by weight. Such latex polymers include vinyl chloride copolymers, vinylidene chloride copolymers, acrylic ester copolymers, like polyethyl acrylate, vinyl acetate copolymers and butadiene copolymers, without however being limited thereto.

The light-sensitive emulsion layer(s) of the material according to the present invention is (are) loaded with light-sensitive silver halide emulsion grains or crystals having a cubic (specifically disclosed in EP-A 0 610 608, 0 649 051, 0 712 036 and 0 794 456) and/or a tabular crystal habit as disclosed for grains having both habits in a multilayer arrangement as in EP-A's 0 770 909 and 0 874 275. Tabular crystals (disclosed e.g. in EP-A's 0 655 645, 0 866 362, 0 933 670, 0 945 754, 0 953 867, 0 962 820, 1 045 282, 1 045 283, and EP-Applications Nos. 99204006, 99204009, 99204010 and 99204011, simultaneously filed Nov. 26, 1999 and in U.S. Pat. No. 5,853,972) may have {100} and/or {111} main faces. Halide compositions may be any selected from the group consisting of chloride, bromide and iodide, provided that relative amounts present are fully compatible with the solubilities of the silver halides in mixed form in the crystals thus formed as is known by anyone skilled in the art. Moreover dopants may be present as e.g. group VIII complex ions, and more particularly rhodium (as in EP-A 0 897 131, 0 933 670 and 0 933 671 and in U.S. Pat. No. 5,856,077), ruthenium (as in EP-A 1 058 150) and iridium dopants as disclosed e.g. in U.S. Pat. Nos. 5,089,379; 5,294,532; 5,368,994 and 5,420,001 wherein in this last reference epitaxial deposits are present on the crystal surface. Halide ions may further be distributed homogeneously or heterogeneously over the crystal volume and may lead to a distribution over the whole emulsion crystal distribution which may be homogeneous or heterogeneous. Furthermore the morphological characteristics of the grains may be homogeneous (as disclosed e.g. in EP-A 0 911 687) or heterogeneous.

In one embodiment, the light-sensitive emulsion layer(s) of the material according to the present invention comprise (s) {111} tabular silver bromo(iodide) grains as those described in U.S. Pat. No. 5,595,864. Said {111} tabular grains are crystals possessing two parallel (111) faces with a ratio of the diameter of a circle having the same area as these faces versus the thickness, being the distance between the two major faces, equal to at least 2, an average equivalent crystal diameter of at least 0.5 μm, an average thickness of from 0.06 to 0.30 μm and wherein said grains account for a total projected area of at least 90% with respect to all grains present. Precipitation methods of tabular silver halide grains are also extensively described in the patent literature. Preferred methods, providing relatively narrow grain size distributions with a variation coefficient of less than 0.30 are described in e.g. U.S. Pat. No. 5,290,655. According to the present invention said silver halide emulsions have tabular grains with a hexagonal {111} crystal habit showing a procentual variation coefficient on average crystal diameter of the silver halide distribution of less than 20%. Though the silver halide emulsions may comprise grains having chloride in combination with bromide or bromoiodide, tabular grain emulsions are preferred comprising silver bromide or silver iodobromide grains having bromide in an amount of at least 90 mole %, an average iodide content of at most 3 mole % and more preferably iodide in an amount of at most 1 mole %. The iodide distribution can be homogeneous over the whole crystal volume or may be present in a so-called core-shell crystal structure, i.e. a silver halide crystal having distinct phases characterized by a different iodide to bromide ratio. More than one shell can be present and between different phases it can be recommended to have a phase enriched in silver iodide by applying the so-called conversion technique during precipitation. Iodide ions can be provided by adding aqueous solutions of inorganic salts thereof as e.g. sodium, potassium or ammonium iodide, by adding organic compounds which are capable of releasing iodide ions as described in the EP-A's 0 561 415; 0 563 701; 0 563 708; 0 649 052 and 0 651 284 or by adding very fine silver iodide grains (so-called Lippmann emulsions having a grain diameter of less then 0.05 μm) as has been disclosed e.g. in EP-A 0 621 505. In order to enhance speed it may be recommended to add to apply reduction sensitization during precipitation as has e.g. been disclosed in EP-A's 0 348 934, 0 371 338, 0 407 576, 0 518 323 and 0 843 209. In another embodiment it is recommended to add during shell precipitation a hole trapping agent as e.g. formic acid or a salt thereof or a rongalite compound as has e.g. been disclosed in EP-A 0 922 994 and in EP-A 1 006 401.

In another embodiment, the light-sensitive emulsion layer (s) of the material according to the present invention comprise(s) (100) cubic silver bromo(iodide) grains as those described in EP-A's 0 610 608, 0 610 609, 0 712 036 and 0 874 275 or cubic grains rich in silver chloride as those disclosed in EP-A 0 794 456. Cubic grains having an average crystal diameter of from 0.05 up to 1.0 μm can be used, depending on the desired densitivity. For laser applications very fine grains are preferred in the range from 0.05 up to 0.30 μm, and even more preferred in the range from 0.10 up to 0.20 μm, whereas for mammography grains having an average diameter of from 0.30 up to 0.90 μm, and more preferably from 0.30 up to 0.70 μm are suitable for use.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and GB-Patent No. 618,061 may be used. The amount of gold (expressed as metallic gold), used in the chemical ripening of emulsions according to the present invention, is preferably in the range of 25 to 45 ppm vs. the amount of metallic silver. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of compounds of Rh, Ru, Pb, Cd, Hg, or Tl can be added.

Also reductors may be added as chemical sensitizers e.g. tin compounds as described in GB-Patent No. 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizer(s) or combinations of said ingredients.

The silver halide emulsion(s) can be spectrally sensitized by adding one or several cyanine dyes, merocyanine dyes, complex cyanine dyes, complex merocyanine dyes, hemicyanine dyes, styryl dyes and hemioxonol dyes. Preferred examples of suitable orthochromatic spectral sensitizers are 5,5'-dichloro-3,3'-bis ($SO_3$—R)-9-ethylbenzoxacarbocyanines with R being n-propylene or n-butylene. Furthermore, green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related to the purpose of obtaining the highest possible photographic speed while reducing dye stain after processing. Another survey of useful chemical classes of spectral sensitizers is described by F. M. Hamer in "The Cyanine Dyes and Related Compounds", 1964, John Wiley & Sons and other examples specifically useful for spectral sensitization of tabular grains are given in Research Disclosure Item 22534. In addition, a more recent overview is given in EP-A 0 757 285.

Traditionally spectral sensitization follows the completion of chemical sensitization. However, the spectral sensitisation of tabular grains in particular may occur simultaneously with or even precede completely the chemical sensitization step: it is generally recognized that spectral sensitizers may act as site-directors during the formation of sensitivity specks by the chemical sensitization of tabular grains, thereby enhancing their photographic properties as has been extensively been described in EP-Application No. 99201190, filed Apr. 16, 1999.

As is well-known the layer which is farthest from the substrate and which does not contain any silver halide is designated as the protective layer. In addition to binders and surface-active substances, such protective layers can optionally also contain other substances which influence the chemical, physical and mechanical properties of the photographic silver halide recording materials. Examples of these substances are lubricants, surface-active substances containing perfluoro-alkyl groups, lattices (polymeric organic particles), fine-particle colloidal crystalline silica dispersions, matting agents (spacers), curing agents, antistatic substances as well as preservatives. The binder coating weight usually lies between 0.5 $g/m^2$ and 2.0 $g/m^2$ for protective layers.

In the protective layers, particularly those at the light-sensitive side, particular compounds may be present as e.g. polythioethers as in EP-Application No. 99204010 or particular mercapto-azoles as in EP-Application No. 99204008, both filed Nov. 26, 1999, wherein a solution is offered in order to provide a good image tone, a high covering power, less residual color and suitable and constant sensitometry (good preservability). Presence of fluoro substituted ionic surfactants besides non-ionic surfactants and inorganic salts as described e.g. in EP-A 0 318 936 provides a good image tone besides a suitable developing temperature latitude and even development.

The silver halide emulsion(s) present in the materials according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 36544 (1994), Chapter VII. These fog-inhibiting agents or stabilizers can be added to the silver halide emulsion prior to, during, or after the ripening thereof and mixtures of two or more of these compounds can be used.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts and those disclosed in Research Disclosure 36544, September 1994, Chapter IX, part A, p. 519. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve besides covering power of the silver image formed, resistance to abrasion in wet processing conditions.

The photographic material of the present invention may further comprise various other additives such as compounds improving the dimensional stability of the photographic material, UV-absorbers, spacing agents, lubricants, plasticizers, antistatic agents, etc. as disclosed in disclosed in Research Disclosure 36544, September 1994, Chapter IX, parts B, C and D, p. 519-521. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex and the like. Particularly preferred antistatic polymers providing permanent electronic conductivity are polyethylene dioxy thiophene polymers as described in EP-A 0 602 713 and 0 628 560, without however being limited thereto.

A common support of the photographic silver halide material used in the image-forming method according to the present invention is a hydrophobic resin support. Hydrophobic resin supports are well known to those skilled in the art and are made e.g. of polyester, polystyrene, polyvinyl chloride, polycarbonate, and those given in Research Disclosure 36544, September 1994, Chapter 15, p. 531, preference being given to polyethylene terephthalate and polyethylene naphthalate.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907. Colored supports may be used in favour of image tone as disclosed e.g. in EP-A's 0 169 039, 0 790 526 and 0 844 520.

Coating of the different layers of the photographic material of the present invention may occur according to any of the known techniques for applying photographic coatings. In particular modern slide hopper and especially curtain coating techniques are applied. In order to increase the coating speed and/or to reduce the coating thickness when using curtain coating, polyacrylamides which are known to increase the shear viscosity can be added to the coating composition of the emulsion layer and/or protective antistress layer. Suitable polyacrylamides are copoly (acrylamide-(meth)acrylic acid), e.g., COPOLY (acrylamide-acrylic acid-sodium acrylate) (87.5:4.1:8.4) in particular the commercial products ROHAFLOC SF710 and ROHAFLOC SF 580 from ROHM. These polyacrylamides are preferably used in amounts of 10 to 500 ppm in the coating composition of the antistress layer and coating occurs simultaneously with the emulsion layer by curtain coating. In this way the emulsion layer thickness can be reduced and coating can proceed at increased speed.

The material according to the present invention, in a preferred embodiment thereof, is a mammographic film material. The silver halide grains present in a mammography film are spectrally sensitized in order to optimally detect the light emitted from the X-ray conversion screen. So a preferred mammography film is characterized by a spectral sensitivity ranging from 5 to 80 microjoules per $m^2$ measured at the emission maximum of the X-ray conversion screen, said spectral sensitivity being defined herein as the amount of exposure to light of a given wavelength required to obtain an optical density Dmin+1.0 after processing. In practical mammographic applications a mammogram is obtained by subjecting a film-screen system to X-ray exposure. In diagnostic image forming methods commercially available X-ray generating device may be used, providing an exposure to soft X-rays with a tube voltage of 20 to 40 kV. A preferred luminescent phosphor coated in the X-ray conversion screen is $Gd_2O_2S$:Tb, which emits green light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398. Phosphor screens with emission spectra in other wavelength ranges, e.g. in the blue spectrum, may also be applicable. The thickness of the phosphor layer depends on the amount of coated phosphor required to obtain the desired screen speed. A preferred intensifying screen used in the method according to the present invention is characterized by a phosphor coating weight of at least 45 $mg/cm^2$ and a phosphor to binder ratio of at least 97:3 as described in EP-A 0 712 036.

In order to obtain a satisfactory image resolution, mammography films comprise one or more light-sensitive silver halide emulsion layer(s) on only one side of a transparent support, which is typically a blue colored polyethyleneterephtalate film having a thickness of 175 μm. One or more subbing layers may be coated directly on the support to improve the adhesion of the emulsion and backing layer(s) to the support. In addition, an undercoat layer between the emulsion and subbing layer(s) may be present. Additional non light-sensitive intermediate layers, containing e.g. dyes in order to provide a suitable image definition, are optional.

Said dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye, known as "filter dye" can be added to an emulsion layer or to one or more non-light-sensitive hydrophilic layers such as the backing layer(s). The presence of such dye(s) in adapted amounts is not only recommended to adjust the sensitivity of the different emulsion layers and eventually the required contrast, but also in order to reduce scattering of exposure radiation and thus to enhance sharpness (a so-called "anti-halation dye". Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in the form of a solid silica particle dispersion as has been disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods has been described in EP-A 0 756 201.

According to the present invention a photographic material is thus provided comprising a support and coated thereon on at least one side one or more hydrophilic light-sensitive layers, wherein at least one of said layers comprises a silver halide emulsion as disclosed hereinbefore. More preferably for mammographic applications said photographic material comprises on only one side of the support only one hydrophilic light-sensitive layer comprising an emulsion as disclosed herein, wherein light-sensitive tabular grains have a coverage of from 5.0 to 9.0 g/m$^2$, expressed as silver nitrate.

The mammographic material is particularly suitable for use in mammographic diagnostic applications and therefore, according to the present invention, a radiological method for obtaining a diagnostic image for mammography is offered, said method comprising the steps of (i) composing a film-screen system by bringing a photographic material as disclosed hereinbefore into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 210 s, and more preferably in a time of from 45 s up to 130 s, by the steps of developing, fixing, rinsing or washing and drying.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,236,816; 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented. In order to reduce "sludge formation" which is favoured by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer as has e.g. been described in EP-A 0 851 282 and in EP-A's 0 992 845 and 1 006 401.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odourless as illustrated in EP-A 0 908 764.

If however aluminum ions are present in the fixer composition for whatever a reason, the presence of $\alpha$-ketocarboxylic acid compounds is recommended as has been described in EP-A's 0 620 483 and 0 726 491 as well as in RD No. 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$, more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable.

Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/$m^2$, more preferred from 20 to 100 ml/$m^2$ and still more preferred from 20 to 50 ml $m^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned before: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0 872 764.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 530, trade name product marketed by Agfa-Gevaert.

EXAMPLES

Example 1

Preparation of the Silver Halide Containing Layer

Preparation of Cubic Grain Emulsion

To 1 l of a solution, containing 15 g of methionine and 50 g of gelatin, adjusted to a pH of 5.8, were added, at 60° C., by double jet addition, a 2.94 M solution of $AgNO_3$ at a constant flow rate of 5.7 ml/min during 5 seconds and a solution of a mixture of 2.91 M of KBr and 0.03 M of KI at a flow rate controlled in order to maintain pAg constant at 7.8. Then the flow rate of the $AgNO_3$ solution was increased linearly up to 21 ml/min during 72 minutes and 46 seconds. The cubic grains thus prepared were composed of 99 mole % AgBr and 1 mole % AgI, based on silver, with an average grain size of 0.63 $\mu$m. After washing, gelatin and water were added in order to obtain a silver halide content of 208 g/kg, expressed as $AgNO_3$, and a gelatin content of 89 g/kg.

To 2.4 kg of this emulsion, the pH of which was adjusted to 6.0, were added consecutively 6 mg of sodium thiosulphate, 70 ml of a solution containing $1.46\times10^{-3}$ M of chloro auric acid and $1.58\times10^{-2}$ M ammonium thiocyanate, 2 ml of a solution of $4.76\times10^{-3}$ M of sodium toluene thiosulphonate in methanol and 38 mg of sodium sulphite. This mixture was heated during 4 hours at 46 ° C. After cooling, a preservative was added.

To the above described silver halide emulsion rich in silver bromide the following additives were added per mol silver halide:

375 mg of 5,5'-dichloro-3,3'-bis(n-butyl-4-sulphonate)-9-ethylbenzoxacarbocyanine, anhydrous triethylammonium salt 785 mg of 4-hydroxy-6-methyl-1,3,3a,7-tetraazaindene 15.5 g of sorbitol 12 g polyethylacrylate, latex as a plasticizer 2.8 g resorcinol 160 mg of potassium bromide 33 g of polydextran (M.W.=10000).

Composition of the protective layer emulsion side (amounts expressed in g/$m^2$):

| | |
|---|---|
| gelatin: | 1.1 |
| polymethylmethacrylate spacing agent (average particle diameter 3 $\mu$m): | 0.015 |
| chromium acetate: | 0.005 |
| 4-hydroxy-6-methyl-1,3,3a,7-tetraazaindene: | 0.082 |
| $CF_3(CF_2)_6$ COOH.$NH_3$: | 0.007 |
| $CF_3(CF_2)_6$ CONH$(CH_2CH_2O)_{17-20}$: | 0.019 |
| Phenol: | 0.150 |
| Mobilcer Q (a paraffin wax, trade name product from MOBIL OIL): | 0.025 |
| formaldehyde (added just before coating): | 0.100 |

Composition of the first back-layer, containing anti-halation dyes and polymers as "anti-curl agents" in g/m2:

| | |
|---|---|
| dye 1 | 0.08 |
| gelatin: indicated in tables of experiments | |
| silica particles having an average diameter of from 7 to 10 nm: | 2.28 |
| dextran or polyacrylamide: amounts indicated in Table I. | |

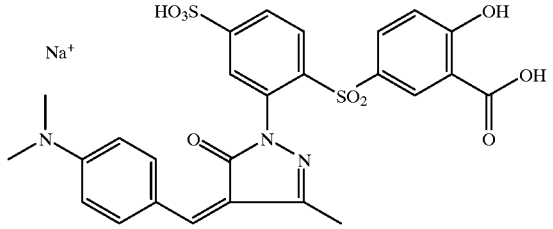

Dye 1

Composition of the protective layer 2 in g/m2:

| | |
|---|---|
| gelatin: | 0.54 |
| $CF_3(CF_2)_6$COOH.$NH_3$: | 0.007 |
| glyoxal: | 0.10 |
| polymethyl metacrylate particles (diameter 7 $\mu$m) | 0.023 |

Coating of the Materials

Emulsion Layer (EL) Containing Silver Halide and Protective Layer 1 (PL1)

The coating solution of the silver halide containing layer was prepared by adding solutions of the compounds indicated above to the melted emulsion while stirring.

The coating solution of the protective layer 1 was obtained by dissolving the above indicated composition in 21 ml per sq.m. of demineralized water. After adjusting pH to a value of 6.7, the viscosity and surface tension of the coating solutions were optimized in order to get an undisturbed coating profile. The emulsion layer(s) and the protective layer were coated simultaneously by means of conventional coating techniques on one side of a subbed polyester support having a thickness of 175 μm.

After coating the emulsion layer was containing (per sq.m.) 8.8 g of silver, expressed as an equivalent amount of silver nitrate, 3.77 g of gelatin and 0.62 g of polyethyl acrylate latex (corresponding with an amount of 16% by weight of latex vs. gelatin).

First Backing Layer (BL1) and Protective Layer 2 (PL2)

The coating solution of the first backing layer was obtained by dissolving the above indicated coating composition in 50 ml per sq.m. of demineralized water and adjusting pH to a value of 6.2.

The coating solution of the protective layer 2 (PL2) was obtained by dissolving the above indicated composition in 19 ml per sq.m. of demineralized water and adjusting pH to a value of 6.2.

Both layers were coated simultaneously on the 175 μm thick polyester support or undercoat decribed above: protective layer 2 (PL2) adjacent to the first backing layer (BL1) and farther from the support, both on the opposite side of the emulsion layer (EL).

The materials were then dried under controlled conditions of heat and relative humidity.

The materials were cut into samples of 18 cm×24 cm.

Processing:

The automatic processing occurred in a glutaraldehyde containing hydroquinone hydroquinone/1-phenyl-3-pyrazolidone developer followed by an aluminum containing fixer marketed by Agfa-Gevaert N. V. under the trade names G138® and G334® respectively.

CURIX 530®, tradename of Agfa-Gevaert N.V., was used as an automatic processing machine. Processing sequence and conditions in the said CURIX 530® processing machine were following (expressed in seconds(sec.), temperature (in ° C.) added thereto:

| | | |
|---|---|---|
| loading: | 3.4 | sec. |
| developing: | 23.4 | sec./35° C. in developer G138 ® |
| cross-over: | 3.8 | sec. |
| fixing: | 15.7 | sec./35° C. in fixer G334 ® |
| cross-over: | 3.8 | sec. |
| rinsing: | 15.7 | sec./20° C. |
| drying: | 32.2 | sec. (cross-over time included) |
| total time: | 98.0 | sec. |

Measuring Technique for Curl Applied to Single-side Coated Materials

Samples of the materials were evaluated for curl before ("BP") and after processing ("AP") in the above decribed processing conditions. The materials were exposed to white light before processing.

Film sheets (unexposed, unprocessed films and exposed, processed films respectivley) having a total surface larger than 10 cm×10 cm and smaller than 24 cm×30 cm were evaluated as follows.

In a conditioned room (20 C./10% RH) the sheets were hung on a drying-frame for at least 4 hours.

Curling was measured according to ISO 4330: curling into the direction of the emulsion side was indicated by character "E" and represented in the Table I with a "+" sign, whereas curling into the direction of the backing layer was indicated by character "B" and represented in the Table I with a "−" sign.

The figures given in the Table I hereinafter are corresponding with inverse value of the measured curling radius (measured according to ISO 4330), expressed in meters. A higher figure is thus indicative for presence of a higher degree of curling (smaller curling radius=more severely curling).

The composition of the backing layers (first backing layer in contact with the subbed support and protective antistress coating as outermost layer) with respect to its binder contents and addenda crucial for curling effects is given in the Table I.

In this example the amount of gelatin is given. All amounts in the Table I hereinafter have been given in g/m$^2$.

TABLE I

| Sample No. | Gelatin 1st backing layer | PEA Latex 1st backing layer | Extractable polymer 1st backing layer Dextran | Curl BP | Curl AP |
|---|---|---|---|---|---|
| 1 (comp.) | 4.9 | 0 | 0 | +0.8 | −5.0 |
| 2 (comp.) | 2.0 | 2.9 | 0 | +10 | +2.5 |
| 3 (inv.) | 2.0 | 0 | 2.9 (MW 10000) | +2.5 | −0.4 |
| 4 (comp.) | 2.0 | 0 | 2.9 (MW 40000) | +2.5 | −0.8 |

A gelatin content of 4.9 g/m$^2$ thus results in a flat material before processing, but in strong curl to the backing side of the material after processing. The example with latex in the 1st backing layer, although reducing curl to a better level after processing, has too high curling characteristics before processing.

Opposite thereto the inventive Sample No. 3, if compared with Sample No.4, both result in the desired relatively low curl before processing but Sample 3, coated with dextran having an average molcular weight of 10000, provides a better result than Sample 4 after processing, as was the object of the present invention.

Example 2

Experimental conditions were the same as those set out in Example 1, except for the compostion of the first backing layer. Silica particles were absent and amounts of gelatin and dextran having an average molecular weight (M.W.) of 10000 have been summarized in Table II hereinafter, together with the curl data, having been evaluated in the same way as in Example 1.

TABLE II

| Sample No. | Gelatin 1st B.L. | Dextran 10000 1st B.L. | Curl BP | Curl AP | Δ Curl BP − AP |
|---|---|---|---|---|---|
| 5 | 2.5 | 0 | +7 | +2.5 | 4.5 |
| 6 | 2.5 | 0.5 | +6 | +2.5 | 3.5 |
| 7 | 2.5 | 1.5 | +5 | +2.5 | 2.5 |
| 8 | 2.5 | 2.5 | +5 | +3 | 2 |
| 9 | 3.5 | 0 | +6 | +1.4 | 4.6 |
| 10 | 3.5 | 0.5 | +5.5 | +1.6 | 3.9 |
| 11 | 3.5 | 1.5 | +4.9 | +1.6 | 3.3 |
| 12 | 3.5 | 2.5 | +3.7 | +1.3 | 2.4 |
| 13 | 4.5 | 0 | +5 | +0.4 | 4.6 |

TABLE II-continued

| Sample No. | Gelatin 1st B.L. | Dextran 10000 1st B.L. | Curl BP | Curl AP | Δ Curl BP − AP |
|---|---|---|---|---|---|
| 14 | 4.5 | 0.5 | +4.5 | +0.3 | 4.2 |
| 15 | 4.5 | 1.5 | +3.5 | 0 | 3.5 |
| 16 | 4.5 | 2.5 | +2.9 | 0 | 2.9 |

Differences between curl before and after processing (Δ BP-AP) clearly decreasing when dextran has been coated in an amount of more than 0.5 g/m$^2$. By addition to the 1st backing layer of dextran having a low M.W. (10000 as given in the present Example) a single side coated material is obtained, showing a lower curl level before and after processing at a low relative humidity, particularly when dextran is present in an amount of at least 50 wt. % vs. gelatin.

Having described in detail preferred embodiments of the current invention, it will now be apparent to those skilled in the art that numerous modifications can be made therein without departing from the scope of the invention as defined in the appending claims.

What is claimed is:

1. Single-side coated light-sensitive silver halide photographic film material comprising, on one side of a subbed support, one or more light-sensitive silver halide emulsion layer(s) overcoated with an outermost protective layer;

said emulsion layer(s) having silver halide grains dispersed in binder, wherein said silver halide is coated in a total amount, expressed as an equivalent amount of silver nitrate of more than 5 g per m$^2$, a latex polymer present in an amount of less than 30% by weight versus said binder, and at the other side of said support, a backing layer, covered with a protective outermost layer, characterized in that at least said backing layer is provided in at least one layer thereof, besides a cross-linked or cross-linkable first binder, with an organic component free from cross-linking upon reaction with a hardener, as a second binder, wherein said organic component is a polymer selected from the group consisting of dextran having a molecular weight not more than 20000 and polyacrylamide having a molecular weight not more than 20000 wherein in at least one layer of said backing layer, said organic component free from cross-linking upon reaction with a hardener should be present in an amount of at least 50%, by weight, versus the amount of cross-linked or cross-linkable first binder and wherein said at least one layer of said backing layer is the first layer of said backing layer, being the layer more close to the subbed support than any other layer with the proviso that said film material has a ΔBP-AP of 4.2 or less.

2. Material according to claim 1, wherein said dextran or polyacrylamide polymer has a molecular weight of from 1000 up to not more than 20000.

3. Material according to claim 1, wherein said organic component free from cross-linking upon reaction with a hardener is present in an amount of from 0.5 up to 5 g/m$^2$.

4. Material according to claim 1, wherein said cross-linked or cross-linkable first binder is gelatin.

5. Material according to claim 1, wherein said hardener is a vinyl sulfonyl hardener.

6. Material according to claim 1, wherein said silver halide is coated in an amount, expressed as an equivalent amount of silver nitrate, of up to at most 10.0 g per m$^2$.

7. Material according to claim 1, wherein said film material is a mammographic film material.

8. Method for obtaining a diagnostic image for mammography comprising the steps of (i) composing a film-screen system by bringing a photographic material according to claim 1 into contact with a radiographic X-ray conversion screen;

(ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 210 s, by the steps of developing, fixing, rinsing or washing and drying.

9. A photographic element comprising:

a support comprising an imaging side and a backing side;

an imaging layer on said imaging side of said support wherein said imaging layer comprises:

a silver halide emulsion layer comprising silver halide dispersed in a binder;

a latex polymer present in an amount of less than 30%, by weight, of said binder; and a protective overcoat a backing on said backing side of said support wherein said backing comprises:

a first backing layer comprising a cross-linked binder;

a second backing layer comprising an organic component free from cross-linking wherein said organic component is a polymer selected from a group consisting of dextran having a molecular weight of no more than 20,000 and polyacrylamide having a molecular weight of no more than 20,000 with the proviso that said photographic element has a ΔBP-AP of 4.2 or less.

10. The photographic element of claim 9 wherein said polymer is dextran.

11. The photographic element of claim 9 wherein said silver halide is coated in a total amount, expressed as an equivalent amount of silver nitrate of more than 5 g per m$^2$.

12. The photographic element of claim 9 wherein said first backing layer is between said second backing layer and said support.

13. The photographic element of claim 9 wherein said second backing layer is between said first backing layer and said support.

14. The photographic element of claim 9 wherein said binder is gelatin.

15. The photographic element of claim 9 wherein said binder is cross-linked with a hardener.

16. The photographic element of claim 15 wherein said hardener is vinyl sulfone.

17. The photographic element of claim 9 wherein said photographic element is a mammographic film.

18. A mammography film comprising:

a support comprising an imaging side and a backing side;

an imaging layer on said imaging side of said support wherein said imaging layer comprises:

a silver halide emulsion layer comprising silver halide dispersed in a binder wherein said silver halide is coated in a total amount, expressed as an equivalent amount of silver nitrate of more than 5 g per m$^2$, a latex polymer present in an amount of less than 30%, by weight, of said binder; and a protective overcoat a backing on said backing side of said support wherein said backing comprises:

a first backing layer comprising a cross-linked binder;

a second backing layer comprising an organic component free from cross-linking wherein said organic component is a polymer selected from a group consisting of dextran having a molecular weight of no more that 20,000 and polyacrylamide having a molecular weight of no more that 20,000 with the proviso that said mammography film has a ΔBP-AP of 4.2 or less.

* * * * *